US008449944B2

(12) United States Patent
Schuette et al.

(10) Patent No.: US 8,449,944 B2
(45) Date of Patent: May 28, 2013

(54) METHOD OF PRODUCING COATED TEXTILE, MORE PARTICULARLY SYNTHETIC LEATHERS

(75) Inventors: Markus Schuette, Osnabrueck (DE); Hauke Malz, Diepholz (DE); Laszlo Szarvas, Ludwigshafen (DE)

(73) Assignee: BASF SE, Ludwigshafen (DE)

( * ) Notice: Subject to any disclaimer, the term of this patent is extended or adjusted under 35 U.S.C. 154(b) by 952 days.

(21) Appl. No.: 12/520,129

(22) PCT Filed: Dec. 12, 2007

(86) PCT No.: PCT/EP2007/063788

§ 371 (c)(1),
(2), (4) Date: Jun. 19, 2009

(87) PCT Pub. No.: WO2008/077786

PCT Pub. Date: Jul. 3, 2008

(65) Prior Publication Data

US 2009/0311929 A1 Dec. 17, 2009

(30) Foreign Application Priority Data

Dec. 22, 2006 (EP) ..... 06126971

(51) Int. Cl.
*B05D 3/10* (2006.01)

(52) U.S. Cl.
USPC ..... 427/341; 427/342

(58) Field of Classification Search
None
See application file for complete search history.

(56) References Cited

U.S. PATENT DOCUMENTS

| | | | | |
|---|---|---|---|---|
| 3,000,757 | A | 9/1961 | Johnston et al. | |
| 3,526,531 | A | 9/1970 | Asano et al. | |
| 3,772,059 | A | 11/1973 | Shikada | |
| 5,037,864 | A * | 8/1991 | Anand et al. | 523/348 |
| 7,737,224 | B2 * | 6/2010 | Willis et al. | 525/333.5 |
| 7,943,543 | B1 * | 5/2011 | Liu et al. | 502/4 |
| 2003/0157351 | A1 * | 8/2003 | Swatloski et al. | 428/478.4 |
| 2004/0031685 | A1 * | 2/2004 | Anderson et al. | 204/468 |
| 2004/0038031 | A1 * | 2/2004 | Holbrey et al. | 428/402.24 |
| 2006/0052493 | A1 * | 3/2006 | Nagano et al. | 524/104 |
| 2008/0073622 | A1 * | 3/2008 | Housel | 252/519.34 |

FOREIGN PATENT DOCUMENTS

| | | |
|---|---|---|
| CN | 1681878 A | 10/2005 |
| DE | 1 110 607 | 7/1961 |
| DE | 102 02 838 | 8/2003 |

OTHER PUBLICATIONS

Office Action issued Sep. 15, 2011, in Chinese Patent Application No. 200780047766.3 (English translation only).

* cited by examiner

*Primary Examiner* — Erma Cameron
(74) *Attorney, Agent, or Firm* — Oblon, Spivak, McClelland, Maier & Neustadt, L.L.P.

(57) ABSTRACT

A process for the production of coated textiles, a textile substrate being coated or impregnated with a solution (I) comprising polyurethane, and the polyurethane then being precipitated in or on the textile substrate, wherein polyurethane dissolved in ionic liquid is used as solution (I).

20 Claims, No Drawings

METHOD OF PRODUCING COATED TEXTILE, MORE PARTICULARLY SYNTHETIC LEATHERS

This application is the national stage application of PCT/EP2007/063788, filed Dec. 12, 2007.

The present invention relates to a process for the production of coated textiles, in particular imitation leather, a textile substrate, preferably a woven fabric, knitted fabric or nonwoven, being coated or impregnated with a solution (I) comprising polyurethane, preferably thermoplastic polyurethane, and the polyurethane then being precipitated in or on the textile substrate, wherein polyurethane dissolved in ionic liquid is used as solution (I). The invention furthermore relates to coated textiles obtainable in this manner, in particular imitation leather.

The production of imitation leather by coating textiles with plastics has long been known. Imitation leathers are used inter alia as shoe upper materials, for articles of apparel, as purse-making material or, for example, in the upholstery sector. In addition to other plastics, such as PVC, in particular polyurethane is used as coating material here. The generally known principles for the coating of textiles with polyurethane are described in W. Schröer, Textilveredlung 1987, 22 (12), 459-467. A description of the coagulation process is moreover to be found in "New Materials Permeable to Water Vapor", Harro Träubel, Springer Verlag, Berlin, Heidelberg, New York, 1999, ISBN 3-540-64946-8, pages 42 to 63.

In particular, the direct coating method, the reverse method (indirect coating) and the coagulation method are used in the production of imitation leather. In contrast to the direct method, in the reverse method the coating is applied to an intermediate substrate with a subsequent lamination step in which combination of the film with the textile substrate and delamination of the intermediate substrate (release paper) are effected. The reverse method is preferably used if textile substrates are used which do not permit high tensile stresses during coating or if open woven fabrics which are not particularly dense are used.

In the coagulation method, a textile substrate is usually coated with a solution comprising polyurethane (also referred to below as PU), generally thermoplastic polyurethane, also referred to below as TPU, in DMF. In a second step, the coated substrate is passed through DMF/water baths, the proportion of water being increased stepwise. This results in precipitation of the PU and the formation of a microporous film. The fact that DMF and water have excellent miscibility and DMF and water serve as a solvent/nonsolvent pair for PU. Coagulated PU coatings are in particular used for high-quality imitation leathers since they have comparatively good breathability and haptic properties for leather. The basic principle of the coagulation process is based on the use of a suitable solvent/nonsolvent pair for PU. The major advantage of the coagulation method is that microporous, breathable imitation leathers having excellent hand can be obtained. Examples are the imitation leather brands Clarino® or Alcantara®. A disadvantage of the coagulation process is the necessity of using large amounts of DMF as an organic solvent. In order to minimize exposure of employees to DMF emissions during production, it is necessary to take additional design measures, which constitute a not inconsiderable additional cost in comparison with the simpler methods. Furthermore, there is the necessity of disposing of or working up large amounts of DMF/water mixtures. This is problematic since water and DMF form an azeotropic mixture and can therefore be separated only at high cost by distillation.

The object of the present invention is therefore to provide a process for coating textile substrates, in particular for the production of imitation leather, in which starting materials, in particular solvents, which are toxicologically as safe as possible and easy and economical to handle can be used. In addition, the process should permit the recycling of off-spec products. The process should be capable of being operated as simply and economically as possible.

The objects could be achieved by the processes described at the outset and products obtainable in this manner.

Use of ionic liquids as solvents has the following advantages:

a. Ionic liquids are generally less toxic than DMF or are not toxic at all.
b. Owing to the low vapor pressure, ionic liquids do not pollute the surrounding air even at elevated temperatures.
c. The above advantages lead to substantially less exposure of the users to volatile organic compounds.
d. Removal of water is substantially facilitated since no azeotropic mixture is formed.
e. Impurities remain as a rule in the ionic liquid so that a highly pure coagulum can be obtained.

In particular, the advantages mentioned under (c) and (d) are significant processing advantages.

Ionic liquids are capable of dissolving PU and can be precipitated again by adding water. Ionic liquids do not form an azeotropic mixture with water and could therefore be more readily separated by distillation. The solution properties as well as biodegradability or the toxicological properties of ionic liquids differ depending on structure and can be optimized to meet the given requirements.

The preparation of the solution (I) according to the invention can preferably be effected by preparing the polyurethane, preferably the thermoplastic polyurethane, in the ionic liquid. The preparation of the polyurethane, preferably of the thermoplastic polyurethane, can be effected in particular by reacting (a) isocyanate with (b) compounds reactive toward isocyanates and (c) chain extenders in the ionic liquid.

Surprisingly, it has been found that ionic liquids have such good dissolution properties that even already prepared polyurethane, preferably thermoplastic polyurethane, can be dissolved again in the ionic liquids. Accordingly, the solution (I) can also be prepared by dissolving polyurethane, preferably thermoplastic polyurethane, in an ionic liquid. Here, preferably a procedure is adopted in which the polyurethane, preferably thermoplastic polyurethane, is added to the ionic liquid and dissolved at a temperature of from 50 to 150° C., preferably from 70 to 130° C. It is thus also preferable to prepare the polyurethane, preferably thermoplastic polyurethane, by reacting (a) isocyanate with (b) compounds reactive toward isocyanates and (c) chain extenders as such, i.e. without a solvent, and then to mix it with the ionic liquid. The solution (I) can thus preferably also be produced by dissolving polyurethane, preferably thermoplastic polyurethane, in ionic liquids.

Assistants (e) may be added to the mixture comprising polyurethane, preferably thermoplastic polyurethane, and ionic liquid.

The weight ratio of polyurethane and ionic liquid in the solution (I) can be chosen within a wide range and is mainly determined by the processing properties, such as the viscosity. Usually, the ratio of ionic liquid to polyurethane is from 20:1 to 1:10, preferably from 10:1 to 1:1, particularly preferably from 4:1 to 2:1. In addition to the ionic liquid, further solvents which preferably mix homogeneously with the ionic liquid can be used as solvents. Preferably, exclusively ionic liquid is used as the solvent for the preparation of the solution (I).

The preparation of polyurethane, preferably thermoplastic polyurethane, by reacting (a) isocyanates with (b) compounds reactive toward isocyanates, preferably having a number average molecular weight of from 500 to 10 000 g/mol, (c) chain extenders having a molecular weight of from 50 to 499 g/mol, if appropriate in the presence of (d) catalysts and/or (e) assistants is generally known to the person skilled in the art and is widely described.

The coating of the textile substrate with the solution (I) comprising the polyurethane dissolved in ionic liquid can be effected by generally customary and known processes. Starting materials and processes for the production of coagulation leather are described, for example, in K. Walter, U. Loose, G. Hebestreit, "Herstellung von Polyurethanen in Lösung für die Kunstlederindustrie", Leder Schuhe Lederwaren, 1990, pages 172-177;

M. Stoll, "Verfahren zur Herstellung poröser Polymerschichten nach dem Koagu-lationsverfahren", Coating, 1994, pages 9-11;

W. Schröer, "Die Beschichtung von Textilien mit Polyurethanen", Textilveredlung, 1987, pages 459-467;

DE 1 110 607.

The components (a), (b), (c) and, if appropriate, (d) and/or (e) usually used in the preparation of the polyurethanes are described by way of example below.

Organic isocyanates (a) which may be used are generally known aliphatic, cycloaliphatic, araliphatic and/or aromatic isocyanates, preferably diisocyanates, for example tri-, tetra-, penta-, hexa-, hepta- and/or octamethylene diisocyanate, 2-methylpentamethylene 1,5-diisocyanate, 2-ethylbutylene 1,4-diisocyanate, pentamethylene 1,5-diisocyanate, butylene 1,4-diisocyanate, 1-isocyanato-3,3,5-trimethyl-5-isocyanatomethylcyclohexane (isophorone diisocyanate, IPDI), 1,4- and/or 1,3-bis(isocyanatomethyl)cyclohexane (HXDI), cyclohexane 1,4-diisocyanate, 1-methylcyclohexane 2,4- and/or 2,6-diisocyanate and/or dicyclohexylmethane 4,4'-, 2,4'- and 2,2'-diisocyanate, diphenylmethane 2,2'-, 2,4'- and/or 4,4'-diisocyanate (MDI), naphthylene 1,5-diisocyanate (NDI), tolylene 2,4- and/or 2,6-diisocyanate (TDI), diphenylmethane diisocyanate, 3,3'-dimethyldiphenyl diisocyanate, 1,2-diphenylethane diisocyanate and/or phenylene diisocyanate. 4,4'-MDI is preferably used.

The generally known compounds reactive toward isocyanates may be used as compounds (b) reactive toward isocyanates, for example polyesterols, polyetherols and/or polycarbonatediols, which are usually also summarized under the term "polyols", having molecular weights of from 500 to 4000 g/mol, preferably from 1000 to 3000 g/mol, in particular from 1500 to 2000 g/mol, and preferably an average functionality of from 1.8 to 2.3, preferably from 1.9 to 2.2, in particular 2.

Chain extenders (c) which may be used are generally known aliphatic, araliphatic, aromatic and/or cycloaliphatic compounds having a molecular weight of from 50 to 499, preferably difunctional compounds, for example diamines and/or alkanediols having 2 to 10 carbon atoms in the alkylene radical, in particular 1,4-butanediol, 1,6-hexanediol, and/or di-, tri-, tetra-, penta-, hexa-, hepta-, octa-, nona- and/or decaalkylene glycols having 3 to 8 carbon atoms, preferably corresponding oligo- and/or polypropylene glycols, it also being possible to use mixtures of chain extenders. Particularly preferred chain extenders are aliphatic diamines, in particular ethylenediamine or propylenediamine or mixtures comprising ethylenediamine and propylenediamine.

Suitable catalysts (d) which accelerate in particular the reaction between the NCO groups of the diisocyanates (a) and the hydroxyl and/or amino groups of the components (b) and (c) are the customary tertiary amines known according to the prior art, such as, for example, triethylamine, dimethylcyclohexylamine, N-methyl-morpholine, N,N'-dimethylpiperazine, 2-(dimethylaminoethoxy)ethanol, diazabicyclo-(2,2,2) octane and the like and in particular organic metal compounds, such as titanic acid esters, iron compounds, such as, for example, iron(III) acetylacetonate, tin compounds, e.g. tin diacetate, tin dioctanoate, tin dilaurate or the dialkyltin salts of aliphatic carboxylic acids, such as dibutyltin diacetate, dibutyltin dilaurate or the like. The catalysts are usually used in amounts of from 0.0001 to 0.1 part by weight per 100 parts by weight of polyhydroxy compound (b).

In addition to catalysts (d), customary assistants and/or additives (e) can also be added to the components (a) to (c). Blowing agents, surface-active substances, fillers, flame proofing agents, nucleating agents, oxidation stabilizers, lubricants and mold release agents, dyes and pigments, if appropriate further stabilizers in addition to the stabilizer mixture according to the invention, e.g. hydrolysis, light or heat stabilizers or stabilizers to prevent discoloration, inorganic and/or organic fillers, reinforcing agents and plasticizers may be mentioned by way of example. In a preferred embodiment, the component (e) also includes hydrolysis stabilizers, such as, for example, polymeric and low molecular weight carbodiimides. In a further embodiment, the TPU may comprise a phosphorus compound. In a preferred embodiment, phosphorus compounds used are organophosphorus compounds of trivalent phosphorus, such as, for example, phosphites and phosphonites. Examples of suitable phosphorus compounds are triphenyl phosphite, diphenyl alkyl phosphite, phenyl dialkyl phosphite, tris(nonylphenyl) phosphite, trilauryl phosphite, trioctadecyl phosphite, distearyl pentaerythrityl diphosphite, tris(2,4-di-tert-butylphenyl) phosphite, diisodecyl pentaerythrityl diphosphite, di(2,4-di-tert-butylphenyl) pentaerythrityl diphosphite, tristearyl sorbitol triphosphite, tetrakis(2,4-di-tert-butylphenyl) 4,4'-diphenylylene diphosphonite, trisisodecyl phosphite, diisodecyl phenyl phosphite and diphenyl isodecyl phosphite or mixtures thereof.

In addition to said components (a), (b) and (c) and, if appropriate, (d) and (e), chain regulators, usually having a molecular weight of from 31 to 499, may also be used. Such chain regulators are compounds which have only one functional group reactive toward isocyanates, such as, for example, monofunctional alcohols, monofunctional amines and/or monofunctional polyols. By means of such chain regulators, it is possible to establish flow behavior, in particular in the case of TPUs, in a controlled manner. Chain regulators can be used in general in an amount of from 0 to 5 parts by weight, preferably from 0.1 to 1 part by weight, based on 100 parts by weight of component b) and by definition are included under the component c).

All molecular weights mentioned in this document have the unit [g/mol].

The polyurethane is preferably based on the reaction of (a) isocyanate, preferably 4,4'-MDI, with (b) compounds reactive toward isocyanates and having a molecular weight of from 500 g/mol to 10 000 g/mol and (c) chain extenders, preferably having a molecular weight of from 50 to 499 g/mol, preferably aliphatic diamines, particularly preferably ethylenediamine and/or propylenediamine, if appropriate in the presence of (d) catalysts and/or (e) assistants.

For establishing the hardness of the polyurethane, the components (b) and (c) can be varied within relatively wide molar ratios. Molar ratios of component (b) to chain extenders (c) to be used altogether which are from 10:1 to 1:10, in particular from 1:1 to 1:4, have proven useful, the hardness of the polyurethanes increasing with increasing content of (c).

The reaction can be effected at customary indices, preferably at an index of from 900 to 1100, particularly preferably at an index of from 950 to 1050. The index is defined by the ratio of the isocyanate groups of component (a) which are used altogether in the reaction to the groups reactive toward isocyanates, i.e. the active hydrogens, of the components (b) and (c). At an index of 100, there is one active hydrogen atom, i.e. one function reactive toward isocyanates, of the components (b) and (c) per isocyanate group of component (a). At indices above 1000, more isocyanate groups than OH groups are present.

Ionic liquids are generally known and widely described. Preferably, the expression "ionic liquids" is understood as meaning compounds, preferably organic compounds, which comprise at least one cation and at least one anion, at least one cation and/or at least one anion comprising an organic radical.

Preferably, the ionic liquids have a melting point of less than 180° C. Particularly preferably, the melting point is in a range of from −50° C. to 150° C., in particular in the range of from −20° C. to 120° C., in particular preferably below 100° C.

Ionic liquids in the context of the present invention are preferably salts of the general formula (A) salts of the general formula (I)

$$[A]_n^+[Y]^{n-} \quad \text{(I)},$$

where n is 1, 2, 3 or 4, $[A]^+$ is a quaternary ammonium cation, an oxonium cation, a sulfonium cation or a phosphonium cation and $[Y]^{n-}$ is a monovalent, divalent, trivalent or tetravalent anion; or (B) mixed salts of the general formulae (II)

$$[A^1]^+[A^2]^+[Y]^{n-} \quad \text{(IIa), where n=2;}$$

$$[A^1]^+[A^2]^+[A^3]^+[Y]^{n-} \quad \text{(IIb), where n=3; or}$$

$$[A^1]^+[A^2]^+[A^3]^+[A^4]^+[Y]^{n-} \quad \text{(IIc), where n=4 and}$$

where $[A^1]^+$, $[A^2]^+$, $[A^3]^+$ and $[A^4]^+$, independently of one another, are selected from the groups mentioned for $[A]^+$ and $[Y]^{n-}$ has the meanings stated under (A); or (C) mixed salts of the general formulae (III)

$$[A^1]^+[A^2]^+[A^3]^+[M^1]^+[Y]^{n-} \quad \text{(IIIa), where n=4;}$$

$$[A^1]^+[A^2]^+[M^1]^+[M^2]^+[Y]^{n-} \quad \text{(IIIb), where n=4;}$$

$$[A^1]^+[M^1]^+[M^2]^+[M^3]^+[Y]^{n-} \quad \text{(IIIc), where n=4;}$$

$$[A^1]^+[A^2]^+[M^1]^+[Y]^{n-} \quad \text{(IIId), where n=3;}$$

$$[A^1]^+[M^1]^+[M^2]^+[Y]^{n-} \quad \text{(IIIe), where n=3;}$$

$$[A^1]^+[M^1]^+[Y]^{n-} \quad \text{(IIIf), where n=2;}$$

$$[A^1]^+[A^2]^+[M^4]^{2+}[Y]^{n-} \quad \text{(IIIg), where n=4;}$$

$$[A^1]^+[M^1]^+[M^4]^{2+}[Y]^{n-} \quad \text{(IIIh), where n=4;}$$

$$[A^1]^+[M^5]^{3+}[Y]^{n-} \quad \text{(IIIi), where n=4; or}$$

$$[A^1]^+[M^4]^{2+}[Y]^{n-} \quad \text{(IIIj), where n=3 and}$$

where $[A^1]^+$, $[A^2]^+$ and $[A^3]^+$, independently of one another, are selected from the groups mentioned for $[A]^+$, $[Y]^{n-}$ has the meaning stated under (A) and $[M^1]^+$, $[M^2]^+$, $[M^3]^+$ are monovalent metal cations, $[M^4]^{2+}$ are divalent metal cations and $[M^5]^{3+}$ are trivalent metal cations.

Compounds which are suitable for the formation of the cation $[A]^+$ of ionic liquids are known, for example, from DE 102 02 838 A1. Thus such compounds may comprise oxygen, phosphorus, sulfur or in particular nitrogen atoms, for example at least one nitrogen atom, preferably 1-10 nitrogen atoms, particularly preferably 1-5, very particularly preferably 1-3 and in particular 1-2, nitrogen atoms. If appropriate, further heteroatoms, such as oxygen, sulfur or phosphorus atoms, may also be present. The nitrogen atom is a suitable carrier of the positive charge in the cation of the ionic liquid, from which, in equilibrium, a proton or an alkyl radical can then migrate to the anion in order to produce an electrically neutral molecule.

Where the nitrogen atom is the carrier of the positive charge in the cation of the ionic liquid, a cation can first be produced in the synthesis of the ionic liquids by quaternization at the nitrogen atom, for example of an amine or nitrogen heterocycle. The quaternization can be effected by alkylation of the nitrogen atom. Depending on the alkylating reagent used, salts having different anions are obtained. In cases where it is not possible to form the desired anion during the quaternization itself, this can be effected in a further synthesis step. Starting, for example, from an ammonium halide, the halide can be reacted with a Lewis acid, a complex anion being formed from halide and Lewis acid. Alternatively, the exchange of a halide ion for the desired anion is possible. This can take place by addition of a metal salt with precipitation of the metal halide formed, via an ion exchanger or by displacement of the halide ion by a strong acid (with liberation of the hydrohalic acid). Suitable processes are described, for example, in Angew. Chem. 2000, 112, pages 3926-3945, and the literature cited therein.

Suitable alkyl radicals with which the nitrogen atom in the amines or nitrogen heterocycles can, for example, be quaternized are $C_1$-$C_{18}$-alkyl, preferably $C_1$-$C_{10}$-alkyl, particularly preferably $C_1$-$C_6$-alkyl and very particularly preferably methyl. The alkyl group may be unsubstituted or may have one or more identical or different substituents.

Preferred compounds are those which comprise at least one five- to six-membered heterocycle, in particular a five-membered heterocycle, which has at least one nitrogen atom and, if appropriate, an oxygen or sulfur atom, particularly preferably those compounds which comprise at least one five- to six-membered heterocycle which has one, two or three nitrogen atoms and one sulfur or one oxygen atom, very particularly preferably those having two nitrogen atoms. Aromatic heterocycles are furthermore preferred.

Particularly preferred compounds are those which have a molecular weight of less than 1000 g/mol, very particularly preferably less than 500 g/mol.

Furthermore, preferred cations are those which are selected from the compounds of the formulae (IVa) to (IVw), (IVa)

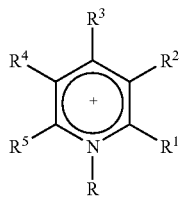

-continued
(IVb)
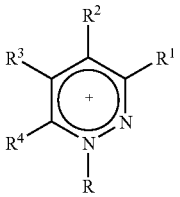
(IVc)
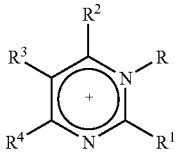
(IVd)
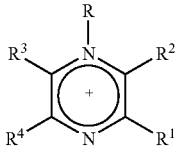
(IVe)
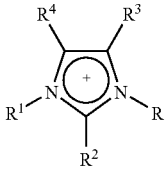
(IVf)
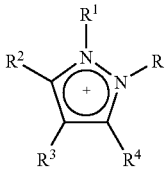
(IVg)
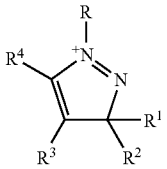
(IVg')
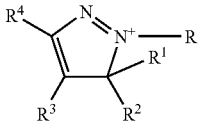
(IVh)
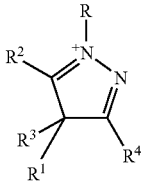
(IVi)
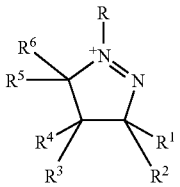
-continued
(IVj)
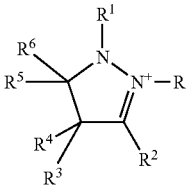
(IVj')
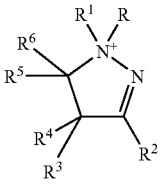
(IVk)
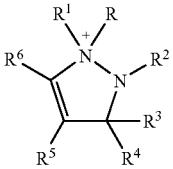
(IVk')
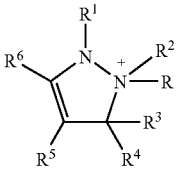
(IVl)
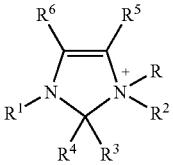
(IVm)
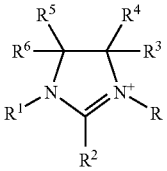
(IVm')
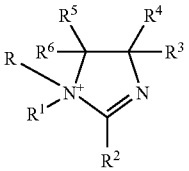
(IVn)
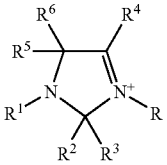
(IVn')
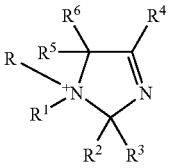

-continued (IVo)

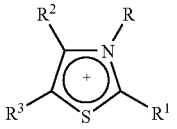

(IVo′)

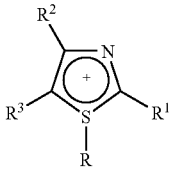

(IVp)

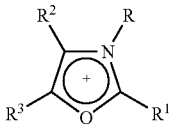

(IVq)

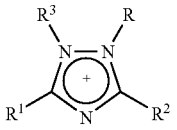

(IVq′)

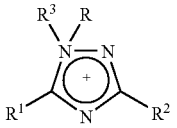

(IVq″)

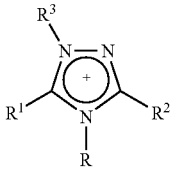

(IVr)

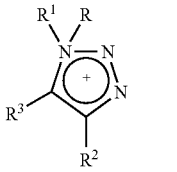

(IVr′)

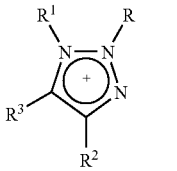

(IVr″)

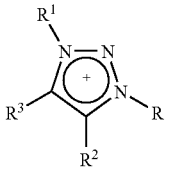

-continued (IVs)

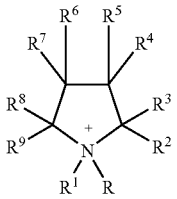

(IVt)

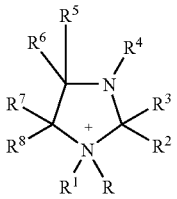

(IVu)

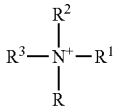

(IVv)

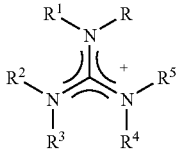

(IVw)

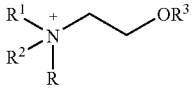

and oligomers which comprise these structures.

Further suitable cations are compounds of the general formulae (IVx) and (IVy)

(IVx)

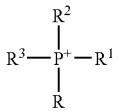

(IVy)

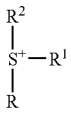

and oligomers which comprise this structure.

In the abovementioned formulae (IVa) to (IVy), the radical R is hydrogen, a carbon-comprising organic, saturated or unsaturated, acyclic or cyclic, aliphatic, aromatic or araliphatic, radical which is unsubstituted or interrupted or substituted by 1 to 5 heteroatoms or suitable functional groups and has 1 to 20 carbon atoms; and the radicals $R^1$ to $R^9$, independently of one another, are hydrogen, a sulfo group or a carbon-comprising organic, saturated or unsaturated, acyclic or cyclic, aliphatic, aromatic or araliphatic radical which is unsubstituted or interrupted or substituted by 1 to 5 heteroatoms or suitable functional groups and has 1 to 20 carbon atoms, it additionally being possible for the radicals $R^1$ to $R^9$ which, in the abovementioned formulae (IV), are bonded to a carbon atom (and not to a heteroatom) to be halogen or a functional group; or two neighboring radicals from the series of $R^1$ to $R^9$ may together also be a divalent, carbon-comprising organic, saturated or unsaturated, acyclic or cyclic, aliphatic, aromatic or araliphatic radical which is unsubstituted or interrupted or substituted by 1 to 5 heteroatoms or suitable functional groups and has 1 to 30 carbon atoms.

In the definition of the radicals R and $R^1$ to $R^9$, suitable heteroatoms are in principle all heteroatoms which are capable of formally replacing a —$CH_2$—, a —CH═, a —C≡ or a ═C═group. If the carbon-comprising radical comprises heteroatoms, then oxygen, nitrogen, sulfur, phosphorus and silicon are preferred. —O—, —S—, —SO—, —$SO_2$—, —NR'—, —N═, —PR'—, —$PR'_2$ and —$SiR'_2$— may be mentioned in particular as preferred groups, the radicals R' being the remaining part of the carbon-comprising radical. In the cases where, in the abovementioned formulae (IV), they are bonded to a carbon atom (and not to a heteroatom), the radicals $R^1$ to $R^9$ can also be bonded directly via the heteroatom.

Suitable functional groups are in principle all functional groups which can be bonded to a carbon atom or a heteroatom. —$NR'_2$ and —CN (cyano) may be mentioned as suitable examples. Functional groups and heteroatoms can also be directly neighboring so that combinations of a plurality of neighboring atoms, such as, for example, —O— (ether), —S— (thioether), —COO— (ester), or —CONR'— (tertiary amide) are also included, for example di($C_1$-$C_4$-alkyl)amino, $C_1$-$C_4$-alkoxycarbonyl or $C_1$-$C_4$-alkoxy. The radicals R' are the remaining part of the carbon-comprising radical.

Fluorine, chlorine, bromine and iodine may be mentioned as halogens.

The radical R is preferably straight-chain or branched $C_1$-$C_{18}$-alkyl which is unsubstituted or mono- to polysubstituted by halogen, phenyl or cyano and has altogether 1 to 20 carbon atoms, such as, for example, methyl, ethyl, 1-propyl, 2-propyl, 1-butyl, 2-butyl, 2-methyl-1-propyl(isobutyl), 2-methyl-2-propyl(tert-butyl), 1-pentyl, 2-pentyl, 3-pentyl, 2-methyl-1-butyl, 3-methyl-1-butyl, 2-methyl-2-butyl, 3-methyl-2-butyl, 2,2-dimethyl-1-propyl, 1-hexyl, 2-hexyl, 3-hexyl, 2-methyl-1-pentyl, 3-methyl-1-pentyl, 4-methyl-1-pentyl, 2-methyl-2-pentyl, 3-methyl-2-pentyl, 4-methyl-2-pentyl, 2-methyl-3-pentyl, 3-methyl-3-pentyl, 2,2-dimethyl-1-butyl, 2,3-dimethyl-1-butyl, 3,3-dimethyl-1-butyl, 2-ethyl-1-butyl, 2,3-dimethyl-2-butyl, 3,3-dimethyl-2-butyl, 1-heptyl, 1-octyl, 1-nonyl, 1-decyl, 1-undecyl, 1-dodecyl, 1-tetradecyl, 1-hexadecyl, 1-octadecyl, benzyl, 3-phenylpropyl, 2-cyanoethyl, 2-(methoxycarbonyl)ethyl, 2-(ethoxycarbonyl)ethyl, 2-(n-butoxycarbonyl)ethyl, trifluoromethyl, difluoromethyl, fluoromethyl, pentafluoroethyl, heptafluoropropyl, heptafluoroisopropyl, nonafluorobutyl, nonafluoroisobutyl, undecylfluoropentyl and undecylfluoroisopentyl;

glycols, butylene glycols and oligomers thereof having 1 to 100 units and a $C_1$-$C_8$-alkyl as terminal group, such as, for example, $R^AO$—($CHR^B$—$CH_2$—O)$_n$—$CHR^B$—$CH_2$— or $R^AO$—($CH_2CH_2CH_2CH_2O$)$_n$—$CH_2CH_2CH_2CH_2O$— where $R^A$ and $R^B$ are preferably methyl or ethyl and n is preferably from 0 to 3, in particular 3-oxabutyl, 3-oxapentyl, 3,6-dioxaheptyl, 3,6-dioxaoctyl, 3,6,9-trioxadecyl, 3,6,9-trioxaundecyl, 3,6,9,12-tetraoxamidecyl and 3,6,9,12-tetraoxatetradecyl;

vinyl;

1-propen-1-yl, 1-propen-2-yl and 1-propen-3-yl; and

N,N-di-$C_1$-$C_6$-alkylamino, such as, for example, N,N-dimethylamino and N,N-diethylamino.

The radical R is particularly preferably straight-chain and unsubstituted $C_1$-$C_{18}$-alkyl, such as, for example, methyl, ethyl, 1-propyl, 1-butyl, 1-pentyl, 1-hexyl, 1-heptyl, 1-octyl, 1-decyl, 1-dodecyl, 1-tetradecyl, 1-hexadecyl, 1-octadecyl, in particular methyl, ethyl, 1-butyl and 1-octyl, and $CH_3O$—($CH_2CH_2O$)$_n$—$CH_2CH_2$— and $CH_3CH_2O$—($CH_2CH_2O$)$_n$—$CH_2CH_2$— where n is from 0 to 3.

The radicals $R^1$ to $R^9$, independently of one another, are preferably hydrogen;

halogen;

a suitable functional group;

$C_1$-$C_{18}$-alkyl which is optionally substituted by suitable functional groups, aryl, alkyl, aryloxy, alkoxy, halogen, heteroatoms and/or heterocycles and/or interrupted by one or more oxygen and/or sulfur atoms and/or one or more substituted or unsubstituted imino groups;

$C_2$-$C_{18}$-alkenyl which is optionally substituted by suitable functional groups, aryl, alkyl, aryloxy, alkoxy, halogen, heteroatoms and/or heterocycles and/or interrupted by one or more oxygen and/or sulfur atoms and/or one or more substituted or unsubstituted imino groups;

$C_6$-$C_{12}$-aryl which is optionally substituted by suitable functional groups, aryl, alkyl, aryloxy, alkoxy, halogen, heteroatoms and/or heterocycles;

$C_5$-$C_{12}$-cycloalkyl which is optionally substituted by suitable functional groups, aryl, alkyl, aryloxy, alkoxy, halogen, heteroatoms and/or heterocycles;

$C_5$-$C_{12}$-cycloalkenyl which is optionally substituted by suitable functional groups, aryl, alkyl, aryloxy, alkoxy, halogen, heteroatoms and/or heterocycles; or a five- to six-membered heterocycle which is optionally substituted by suitable functional groups, aryl, alkyl, aryloxy, alkoxy, halogen, heteroatoms and/or heterocycles and has oxygen, nitrogen and/or sulfur atoms; or two neighboring radicals, together with the atoms to which they are bonded, are an unsaturated, saturated or aromatic ring which is optionally substituted by suitable functional groups, aryl, alkyl, aryloxy, alkoxy, halogen, heteroatoms and/or heterocycles and optionally interrupted by one or more oxygen and/or sulfur atoms and/or one or more substituted or unsubstituted imino groups.

$C_1$-$C_{18}$-Alkyl which is optionally substituted by suitable functional groups, aryl, alkyl, aryloxy, alkoxy, halogen, heteroatoms and/or heterocycles is preferably methyl, ethyl, 1-propyl, 2-propyl, 1-butyl, 2-butyl, 2-methyl-1-propyl (isobutyl), 2-methyl-2-propyl(tert-butyl), 1-pentyl, 2-pentyl, 3-pentyl, 2-methyl-1-butyl, 3-methyl-1-butyl, 2-methyl-2-butyl, 3-methyl-2-butyl, 2,2-dimethyl-1-propyl, 1-hexyl, 2-hexyl, 3-hexyl, 2-methyl-1-pentyl, 3-methyl-1-pentyl, 4-methyl-1-pentyl, 2-methyl-2-pentyl, 3-methyl-2-pentyl, 4-methyl-2-pentyl, 2-methyl-3-pentyl, 3-methyl-3-pentyl, 2,2-dimethyl-1-butyl, 2,3-dimethyl-1-butyl, 3,3-dimethyl-1-butyl, 2-ethyl-1-butyl, 2,3-dimethyl-2-butyl, 3,3-dimethyl-2-butyl, heptyl, octyl, 2-ethylhexyl, 2,4,4-trimethylpentyl, 1,1,3,3-tetramethylbutyl, 1-nonyl, 1-decyl, 1-undecyl, 1-dodecyl, 1-tridecyl, 1-tetradecyl, 1-pentadecyl, 1-hexadecyl, 1-heptadecyl, 1-octadecyl, cyclopentylmethyl, 2-cyclopentylethyl, 3-cyclopentylpropyl, cyclohexylmethyl, 2-cyclohexylethyl, 3-cyclohexylpropyl, benzyl(phenylmethyl), diphenylmethyl(benzhydryl), triphenylmethyl, 1-phenylethyl, 2-phenylethyl, 3-phenylpropyl, α,α-dimethylbenzyl, p-tolylmethyl, 1-(p-butylphenyl)ethyl, p-chlorobenzyl, 2,4-dichlorobenzyl, p-methoxybenzyl, m-ethoxybenzyl, 2-cyanoethyl, 2-cyanopropyl, 2-methoxycarbonylethyl, 2-ethoxycarbonylethyl, 2-butoxycarbonyl-propyl, 1,2-di(methoxycarbonyl)ethyl, methoxy, ethoxy, 1,3-dioxolan-2-yl, 1,3-dioxan-2-yl, 2-methyl-1,3-dioxolan-2-yl, 4-methyl-1,3-dioxolan-2-yl, 2-dimethylaminoethyl, 2-dimethylaminopropyl, 3-dimethylaminopropyl, 4-dimethylaminobutyl, 6-dimethylaminohexyl, 2-phenoxyethyl, 2-phenoxypropyl, 3-phenoxypropyl, 4-phenoxybutyl, 6-phenoxyhexyl, 2-methoxyethyl, 2-methoxypropyl, 3-methoxypropyl, 4-methoxybutyl, 6-methoxyhexyl, 2-ethoxyethyl, 2-ethoxypropyl, 3-ethoxypropyl, 4-ethoxybutyl, 6-ethoxyhexyl, $C_nF_{2(n-a)+(1-b)}H_{2a+b}$ where n is from 1 to 30, $0 \leqq a \leqq n$ and b=0 or 1 (for example $CF_3$, $C_2F_5$, $CH_2CH_2—C_{(n-2)}F_{2(n-2)+1}$, $C_6F_{13}$, $C_8F_{17}$, $C_{10}F_{21}$, $C_{12}F_{25}$), chloromethyl, 2-chloroethyl, trichloromethyl, 1,1-dimethyl-2-chloroethyl, methoxymethyl, 2-butoxyethyl, diethoxymethyl, diethoxyethyl, 2-isopropoxyethyl, 2-butoxypropyl, 2-octyloxyethyl, 2-methoxyisopropyl, 2-(methoxycarbonyl)methyl, 2-(ethoxycarbonyl)-methyl, 2-(n-butoxycarbonyl)methyl, butylthiomethyl, 2-dodecylthioethyl, 2-phenylthioethyl, 5-methoxy-3-oxapentyl, 8-methoxy-3,6-dioxaoctyl, 11-methoxy-3,6,9-trioxaundecyl, 7-methoxy-4-oxaheptyl, 11-methoxy-4,8-dioxaundecyl, 15-methoxy-4,8,12-trioxapentadecyl, 9-methoxy-5-oxanonyl, 14-methoxy-5,10-dioxatetradecyl, 5-ethoxy-3-oxapentyl, 8-ethoxy-3,6-dioxaoctyl, 11-ethoxy-3,6,9-trioxaundecyl, 7-ethoxy-4-oxaheptyl, 11-ethoxy-4,8-dioxaundecyl, 15-ethoxy-4,8,12-trioxapentadecyl, 9-ethoxy-5-oxanonyl or 14-ethoxy-5,10-oxatetradecyl.

$C_2$-$C_{18}$-Alkenyl which is optionally substituted by suitable functional groups, aryl, alkyl, aryloxy, alkoxy, halogen, heteroatoms and/or heterocycles and/or interrupted by one or more oxygen and/or sulfur atoms and/or one or more substituted or unsubstituted imino groups is preferably vinyl, 2-propenyl, 3-butenyl, cis-2-butenyl, trans-2-butenyl or $C_nF_{2(n-a)-(1-b)}H_{2a-b}$ where $n \leqq 30$, $0 \leqq a \leqq n$ and b=0 or 1.

$C_6$-$C_{12}$-Aryl which is optionally substituted by suitable functional groups, aryl, alkyl, aryloxy, alkoxy, halogen, heteroatoms and/or heterocycles is preferably phenyl, tolyl, xylyl, α-naphthyl, β-naphthyl, 4-biphenylyl, chlorophenyl, dichlorophenyl, trichlorophenyl, difluorophenyl, methylphenyl, dimethylphenyl, trimethylphenyl, ethylphenyl, diethylphenyl, isopropylphenyl, tert-butylphenyl, dodecylphenyl, methoxyphenyl, dimethoxyphenyl, ethoxyphenyl, hexyloxyphenyl, methylnaphthyl, isopropylnaphthyl, chloronaphthyl, ethoxynaphthyl, 2,6-dimethylphenyl, 2,4,6-trimethylphenyl, 2,6-dimethoxyphenyl, 2,6-dichlorophenyl, 4-bromophenyl, 2-nitrophenyl, 4-nitrophenyl, 2,4-dinitrophenyl, 2,6-dinitrophenyl, 4-dimethyl-aminophenyl, 4-acetylphenyl, methoxyethylphenyl, ethoxymethylphenyl, methylthiophenyl, isopropylthiophenyl or tert-butylthiophenyl or $C_6F_{(5-a)}H_a$ where $0 \leqq a \leqq 5$.

$C_5$-$C_{12}$-Cycloalkyl which is optionally substituted by suitable functional groups, aryl, alkyl, aryloxy, alkoxy, halogen, heteroatoms and/or heterocycles is preferably cyclopentyl, cyclohexyl, cyclooctyl, cyclododecyl, methylcyclopentyl, dimethylcyclopentyl, methylcyclohexyl, dimethylcyclohexyl, diethylcyclohexyl, butylcyclohexyl, methoxycyclohexyl, dimethoxycyclohexyl, diethoxycyclohexyl, butylthiocyclohexyl, chlorocyclohexyl, dichlorocyclohexyl, dichlorocyclopentyl, $C_nF_{2(n-a)-(1-b)}H_{2a-b}$ where $n \leqq 30$, $0 \leqq a \leqq n$ and b=0 or 1, and a saturated or unsaturated bicyclic system, such as, for example, norbornyl or norbornenyl.

$C_5$-$C_{12}$-Cycloalkenyl which is optionally substituted by suitable functional groups, aryl, alkyl, aryloxy, alkoxy, halogen, heteroatoms and/or heterocycles is preferably 3-cyclopentenyl, 2-cyclohexenyl, 3-cyclohexenyl, 2,5-cyclohexadienyl or $C_nF_{2(n-a)-3(1-b)}H_{2a-3b}$ where $n \leqq 30$, $0 \leqq a \leqq n$ and b=0 or 1.

A five- to six-membered heterocycle which is optionally substituted by suitable functional groups, aryl, alkyl, aryloxy, alkoxy, halogen, heteroatoms and/or heterocycles and has oxygen, nitrogen and/or sulfur atoms is preferably furyl, thiophenyl, pyrryl, pyridyl, indolyl, benzoxazolyl, dioxolyl, dioxyl, benzimidazolyl, benzthiazolyl, dimethylpyridyl, methylquinolyl, dimethylpyrryl, methoxyfuryl, dimethoxypyridyl or difluoropyridyl.

If two neighboring radicals together form an unsaturated, saturated or aromatic ring which is optionally substituted by suitable functional groups, aryl, alkyl, aryloxy, alkoxy, halogen, heteroatoms and/or heterocycles and optionally interrupted by one or more oxygen and/or sulfur atoms and/or one or more substituted or unsubstituted imino groups, it is preferably 1,3-propylene, 1,4-butylene, 1,5-pentylene, 2-oxa-1,3-propylene, 1-oxa-1,3-propylene, 2-oxa-1,3-propylene, 1-oxa-1,3-propenylene, 3-oxa-1,5-pentylene, 1-aza-1,3-propenylene, 1-$C_1$-$C_4$-alkyl-1-aza-1,3-propenylene, 1,4-buta-1,3-dienylene, 1-aza-1,4-buta-1,3-dienylene or 2-aza-1,4-buta-1,3-dienylene.

If the abovementioned radicals comprise oxygen and/or sulfur atoms and/or substituted or unsubstituted imino groups, the number of oxygen and/or sulfur atoms and/or imino groups is not limited. As a rule, it is not more than 5 in the radical, preferably not more than 4 and very particularly preferably not more than 3.

If the abovementioned radicals comprise heteroatoms, as a rule at least one carbon atom, preferably at least two carbon atoms, is or are present between two heteroatoms.

The radicals $R^1$ to $R^9$, independently of one another, are particularly preferably hydrogen;

straight-chain or branched $C_1$-$C_{18}$-alkyl which is unsubstituted or mono- to polysubstituted by halogen, phenyl, cyano and/or $C_1$-$C_6$-alkoxycarbonyl and has altogether 1 to 20 carbon atoms, such as, for example, methyl, ethyl, 1-propyl, 2-propyl, 1-butyl, 2-butyl, 2-methyl-1-propyl(isobutyl), 2-methyl-2-propyl(tert-butyl), 1-pentyl, 2-pentyl, 3-pentyl, 2-methyl-1-butyl, 3-methyl-1-butyl, 2-methyl-2-butyl, 3-methyl-2-butyl, 2,2-dimethyl-1-propyl, 1-hexyl, 2-hexyl, 3-hexyl, 2-methyl-1-pentyl, 3-methyl-1-pentyl, 4-methyl-1-pentyl, 2-methyl-2-pentyl, 3-methyl-2-pentyl, 4-methyl-2-pentyl, 2-methyl-3-pentyl, 3-methyl-3-pentyl, 2,2-dimethyl-1-butyl, 2,3-dimethyl-1-butyl, 3,3-dimethyl-1-butyl, 2-ethyl-1-butyl, 2,3-dimethyl-2-butyl, 3,3-dimethyl-2-butyl, 1-heptyl, 1-octyl, 1-nonyl, 1-decyl, 1-undecyl, 1-dodecyl, 1-tetradecyl, 1-hexadecyl, 1-octadecyl, benzyl, 3-phenylpropyl, 2-cyanoethyl, 2-(methoxycarbonyl)ethyl, 2-(ethoxycarbonyl)ethyl, 2-(n-butoxycarbonyl)ethyl, trifluoromethyl, difluoromethyl, fluoromethyl, pentafluoroethyl, heptafluoropropyl, heptafluoroisopropyl, nonafluorobutyl, nonafluoroisobutyl, undecylfluoropentyl and undecylfluoroisopentyl;

glycols, butylene glycols and oligomers thereof having 1 to 100 units and a $C_1$- to $C_8$-alkyl as terminal group, such as, for example, $R^AO—(CHR^B—CH_2—O)_n—CHR^B—CH_2—$ or $R^AO—(CH_2CH_2CH_2CH_2O)_n—CH_2CH_2CH_2CH_2O—$ where $R^A$ and $R^B$ are preferably methyl or ethyl and n is preferably from 0 to 3, in particular 3-oxabutyl, 3-oxapentyl, 3,6-dioxaheptyl, 3,6-dioxaoctyl, 3,6,9-trioxadecyl, 3,6,9-trioxaundecyl, 3,6,9,12-tetraoxamidecyl and 3,6,9,12-tetraoxatetradecyl;

vinyl;

1-propen-1-yl, 1-propen-2-yl and 1-propen-3-yl; and

N,N-di-$C_1$-$C_6$-alkylamino, such as, for example, N,N-dimethylamino and N,N-diethylamino, $R^3$ not being hydrogen when IIIw is III.

Very particularly preferably, the radicals $R^1$ to $R^9$, independently of one another, are hydrogen or $C_1$-$C_{18}$-alkyl, such as, for example, methyl, ethyl, 1-butyl, 1-pentyl, 1-hexyl, 1-heptyl, 1-octyl, phenyl, 2-cyanoethyl, 2-(methoxycarbonyl) ethyl, 2-(ethoxycarbonyl)-ethyl, 2-(n-butoxycarbonyl)ethyl, N,N-dimethylamino, N,N-diethylamino, chlorine and $CH_3O—(CH_2CH_2O)_n—CH_2CH_2—$ and $CH_3CH_2O—(CH_2CH_2O)_n—CH_2CH_2—$ where n is from 0 to 3, $R^3$ not being hydrogen when IIIw is III.

Very particularly preferably used pyridinium ions (IVa) are those in which one of the radicals $R^1$ to $R^5$ is methyl, ethyl or chlorine and the remaining radicals $R^1$ to $R^5$ are hydrogen;

$R^3$ is dimethylamino and the remaining radicals $R^1$, $R^2$, $R^4$ and $R^5$ are hydrogen;

all radicals $R^1$ to $R^5$ are hydrogen;

$R^1$ and $R^2$ or $R^2$ and $R^3$ form 1,4-buta-1,3-dienylene and the remaining radicals $R^1$, $R^2$, $R^4$ and $R^5$ are hydrogen;

and in particular those in which $R^1$ to $R^5$ are hydrogen; or one of the radicals $R^1$ to $R^5$ is methyl or ethyl and the remaining radicals $R^1$ to $R^5$ are hydrogen.

1-Methylpyridinium, 1-ethylpyridinium, 1-(1-butyl)pyridinium, 1-(1-hexyl)pyridinium, 1-(1-octyl)pyridinium, 1-(1-hexyl)pyridinium, 1-(1-octyl)pyridinium, 1-(1-dodecyl)-pyridinium, 1-(1-tetradecyl)pyridinium, 1-(1-hexadecyl) pyridinium, 1,2-dimethyl-pyridinium, 1-ethyl-2-methylpyridinium, 1-(1-butyl)-2-methylpyridinium, 1-(1-hexyl)-2-methylpyridinium, 1-(1-octyl)-2-methylpyridinium, 1-(1-dodecyl)-2-methylpyridinium, 1-(1-tetradecyl)-2-methylpyridinium, 1-(1-hexadecyl)-2-methylpyridinium, 1-methyl-2-ethylpyridinium, 1,2-diethylpyridinium, 1-(1-butyl)-2-ethylpyridinium, 1-(1-hexyl)-2-ethylpyridinium, 1-(1-octyl)-2-ethylpyridinium, 1-(1-dodecyl)-2-ethylpyridinium, 1-(1-tetradecyl)-2-ethylpyridinium, 1-(1-hexadecyl)-2-ethylpyridinium, 1,2-dimethyl-5-ethyl pyridinium, 1,5-diethyl-2-methylpyridinium, 1-(1-butyl)-2-methyl-3-ethylpyridinium, 1-(1-hexyl)-2-methyl-3-ethylpyridinium and 1-(1-octyl)-2-methyl-3-ethylpyridinium, 1-(1-dodecyl)-2-methyl-3-ethylpyridinium, 1-(1-tetradecyl)-2-methyl-3-ethylpyridinium and 1-(1-hexadecyl)-2-methyl-3-ethylpyridinium may be mentioned as very particularly preferred pyridinium ions (IVa).

Very particularly preferably used pyridazinium ions (IVb) are those in which $R^1$ to $R^4$ are hydrogen; or one of the radicals $R^1$ to $R^4$ is methyl or ethyl and the remaining radicals $R^1$ to $R^4$ are hydrogen.

Very particularly preferably used pyridinium ions (IVc) are those in which $R^1$ is hydrogen, methyl or ethyl and $R^2$ to $R^4$, independently of one another, are hydrogen or methyl; or $R^1$ is hydrogen, methyl or ethyl, $R^2$ and $R^4$ are methyl and $R^3$ is hydrogen.

Very particularly preferably used pyrazinium ions (IVd) are those in which $R^1$ is hydrogen, methyl or ethyl and $R^2$ to $R^4$, independently of one another, are hydrogen or methyl;

$R^1$ is hydrogen, methyl or ethyl, $R^2$ and $R^4$ are methyl and $R^3$ is hydrogen;

$R^1$ to $R^4$ are methyl; or $R^1$ to $R^4$ are hydrogen.

Very particularly preferably used imidazolium ions (IVe) are those in which $R^1$ is hydrogen, methyl, ethyl, 1-propyl, 1-butyl, 1-pentyl, 1-hexyl, 1-octyl or 2-cyanoethyl and $R^2$ to $R^4$, independently of one another, are hydrogen, methyl or ethyl.

1-Methylimidazolium, 1-ethylimidazolium, 1-(1-butyl) imidazolium, 1-(1-octyl)-imidazolium, 1-(1-dodecyl)imidazolium, 1-(1-tetradecyl)imidazolium, 1-(1-hexadecyl)-imidazolium, 1,3-dimethylimidazolium, 1-ethyl-3-methylimidazolium, 1-(1-butyl)-3-methylimidazolium, 1-(1-butyl)-3-ethylimidazolium, 1-(1-hexyl)-3-methylimidazolium, 1-(1-hexyl)-3-ethylimidazolium, 1-(1-hexyl)-3-butylimidazolium, 1-(1-octyl)-3-methylimidazolium, 1-(1-octyl)-3-ethylimidazolium, 1-(1-octyl)-3-butylimidazolium, 1-(1-dodecyl)-3-methylimidazolium, 1-(1-dodecyl)-3-ethylimidazolium, 1-(1-dodecyl)-3-butylimidazolium, 1-(1-dodecyl)-3-octylimidazolium, 1-(1-tetradecyl)-3-methyl-imidazolium, 1-(1-tetradecyl)-3-ethylimidazolium, 1-(1-tetradecyl)-3-butylimidazolium, 1-(1-tetradecyl)-3-octylimidazolium, 1-(1-hexadecyl)-3-methylimidazolium, 1-(1-hexadecyl)-3-ethylimidazolium, 1-(1-hexadecyl)-3-butylimidazolium, 1-(1-hexadecyl)-3-octylimidazolium, 1,2-dimethylimidazolium, 1,2,3-trimethyl-imidazolium, 1-ethyl-2,3-dimethylimidazolium, 1-(1-butyl)-2,3-dimethylimidazolium, 1-(1-hexyl)-2,3-dimethylimidazolium, 1-(1-octyl)-2,3-dimethylimidazolium, 1,4-dimethylimidazolium, 1,3,4-trimethylimidazolium, 1,4-dimethyl-3-ethylimidazolium, 3-butylimidazolium, 1,4-dimethyl-3-octylimidazolium, 1,4,5-trimethylimidazolium, 1,3,4,5-tetramethylimidazolium, 1,4,5-trimethyl-3-ethylimidazolium, 1,4,5-trimethyl-3-butylimidazolium, 1,4,5-trimethyl-3-octylimidazolium and 1-(prop-1-en-3-yl)-3-methylimidazolium may be mentioned as very particularly preferred imidazolium ions (IVe).

Very particularly preferably used pyrazolium ions (IVf), (IVg) or (IVg') are those in which $R^1$ is hydrogen, methyl or ethyl and $R^2$ to $R^4$, independently of one another, are hydrogen or methyl.

Very particularly preferably used pyrazolium ions (IVh) are those in which $R^1$ to $R^4$, independently of one another, are hydrogen or methyl.

Very particularly preferably used 1-pyrazolinium ions (IVi) are those in which $R^1$ to $R^6$, independently of one another, are hydrogen or methyl.

Very particularly preferably used 2-pyrazolinium ions (IVj) or (IVj') are those in which $R^1$ is hydrogen, methyl, ethyl or phenyl and $R^2$ to $R^6$, independently of one another, are hydrogen or methyl.

Very particularly preferably used 3-pyrazolinium ions (IVk) or (IVk') are those in which $R^1$ and $R^2$, independently of one another, are hydrogen, methyl, ethyl or phenyl and $R^3$ to $R^6$, independently of one another, are hydrogen or methyl.

Very particularly preferably used imidazolinium ions (IVl) are those in which $R^1$ and $R^2$, independently of one another, are hydrogen, methyl, ethyl, 1-butyl or phenyl, $R^3$ and $R^4$, independently of one another, are hydrogen, methyl or ethyl and $R^5$ and $R^6$, independently of one another, are hydrogen or methyl.

Very particularly preferably used imidazolinium ions (IVm) or (IVm') are those in which $R^1$ and $R^2$, independently of one another, are hydrogen, methyl or ethyl and $R^3$ to $R^6$, independently of one another, are hydrogen or methyl.

Very particularly preferably used imidazolinium ions (IVn) or (IVn') are those in which $R^1$ to $R^3$, independently of one another, are hydrogen, methyl or ethyl and $R^4$ to $R^6$, independently of one another, are hydrogen or methyl.

Very particularly preferably used thiazolium ions (IVo) or (IVo') and very particularly preferably used oxazolium ions (IVp) are those in which $R^1$ is hydrogen, methyl, ethyl or phenyl and $R^2$ and $R^3$, independently of one another, are hydrogen or methyl.

Very particularly preferably used 1,2,4-triazolium ions (IVq), (IVq') or (IVq") are those in which $R^1$ and $R^2$, independently of one another, are hydrogen, methyl, ethyl or phenyl and $R^3$ is hydrogen, methyl or phenyl.

Very particularly preferably used 1,2,3-triazolium ions (IVr), (IVr') or (IVr") are those in which $R^1$ is hydrogen, methyl or ethyl and $R^2$ and $R^3$, independently of one another, are hydrogen or methyl, or $R^2$ and $R^3$ together form 1,4-buta-1,3-dienylene.

Very particularly preferably used pyrrolidinium ions (IVs) are those in which $R^1$ is hydrogen, methyl, ethyl or phenyl and $R^2$ to $R^9$, independently of one another, are hydrogen or methyl.

Very particularly preferably used imidazolidinium ions (IVt) are those in which $R^1$ and $R^4$, independently of one another, are hydrogen, methyl, ethyl or phenyl and $R^2$ and $R^3$ and $R^5$ to $R^8$, independently of one another, are hydrogen or methyl.

Very particularly preferably used ammonium ions (IVu) are those in which $R^1$ to $R^3$, independently of one another, are $C_1$- to $C_{18}$-alkyl; or $R^1$ and $R^2$ together form 1,5-pentylene or 3-oxa-1,5-pentylene and $R^3$ is $C_1$-$C_{18}$-alkyl or 2-cyanoethyl.

Methyl tri(1-butyl)ammonium, N,N-dimethylpiperidinium and N,N-dimethylmorpholinium may be mentioned as very particularly preferred ammonium ions (IVu).

Examples of the tertiary amines from which the quaternary ammonium ions of the general formula (IVu) are derived by quaternization with said radicals R are diethyl-n-butylamine, diethyl-tert-butylamine, diethyl-n-pentylamine, diethylhexylamine, diethyloctylamine, diethyl(2-ethylhexyl)amine, di-n-propylbutylamine, di-n-propyl-n-pentylamine, di-n-propylhexylamine, di-n-propyloctylamine, di-n-propyl(2-ethylhexyl)-amine, diisopropylethylamine, diisopropyl-n-propylamine, diisopropylbutylamine, diisopropylpentylamine, diisopropylhexylamine, diisopropyloctylamine, diisopropyl-(2-ethylhexyl)amine, di-n-butylethylamine, di-n-butyl-n-propylamine, Di-n-butyl-n-pentylamine, di-n-butylhexylamine, di-n-butyloctylamine, di-n-butyl(2-ethylhexyl)-amine, N-n-butylpyrrolidine, N-sec-butylpyrrodidine, N-tert-butylpyrrolidine, N-n-pentylpyrrolidine, N,N-dimethylcyclohexylamine, N,N-diethylcyclohexylamine, N,N-di-n-butylcyclohexylamine, N-n-propylpiperidine, N-isopropylpiperidine, N-n-butyl-piperidine, N-sec-butylpiperidine, N-tert-butylpiperidine, N-n-pentylpiperidine, N-n-butylmorpholine, N-sec-butylmorpholine, N-tert-butylmorpholine, N-n-pentylmorpholine, N-benzyl-N-ethylaniline, N-benzyl-N-n-propylaniline, N-benzyl-N-isopropylaniline, N-benzyl-N-n-butylaniline, N,N-dimethyl-p-toluidine, N,N-diethyl-p-toluidine, N,N-di-n-butyl-p-toluidine, diethylbenzylamine, di-n-propylbenzylamine, di-n-butylbenzylamine, diethylphenylamine, di-n-propylphenylamine and di-n-butyl-phenylamine.

Preferred quaternary ammonium salts of the general formula (IVu) are those which can be derived from the following tertiary amines by quaternization with said radicals R such as diisopropylethylamine, diethyl-tert-butylamine, diisopropylbutylamine, di-n-butyl-n-pentylamine, N,N-di-n-butylcyclohexylamine and tertiary amines of pentyl isomers.

Particularly preferred tertiary amines are di-n-butyl-n-pentylamine and tertiary amines of pentyl isomers. A further preferred tertiary amine which has three identical radicals is triallylamine.

Very particularly preferably used guanidinium ions (IVv) are those in which $R^1$ to $R^5$ are methyl.

N,N,N',N',N",N"-Hexamethylguanidinium may be mentioned as a very particularly preferred guanidinium ion (IVv).

Very particularly preferably used cholinium ions (IVw) are those in which $R^1$ and $R^2$, independently of one another, are methyl, ethyl, 1-butyl or 1-octyl and $R^3$ is methyl or ethyl;

$R^1$ is methyl, ethyl, 1-butyl or 1-octyl, $R^2$ is a —$CH_2$—$CH_2$—$OR^4$ group and $R^3$ and $R^4$, independently of one another, are methyl or ethyl; or $R^1$ is a —$CH_2$—$CH_2$—$OR^4$ group, $R^2$ is a —$CH_2$—$CH_2$—$OR^5$ group and $R^3$ to $R^5$, independently of one another, are methyl or ethyl.

Particularly preferred cholinium ions (IVw) are those in which $R^3$ is selected from methyl, ethyl, 5-methoxy-3-oxapentyl, 8-methoxy-3,6-dioxaoctyl, 11-methoxy-3,6,9-trioxaundecyl, 7-methoxy-4-oxaheptyl, 11-methoxy-4,8-dioxaundecyl, 15-methoxy-4,8,12-trioxapentadecyl, 9-methoxy-5-oxanonyl, 14-methoxy-5,10-oxatetradecyl, 5-ethoxy-3-oxapentyl, 8-ethoxy-3,6-dioxaoctyl, 11-ethoxy-3,6,9-trioxaundecyl, 7-ethoxy-4-oxaheptyl, 11-ethoxy-4,8-dioxaundecyl, 15-ethoxy-4,8,12-trioxapentadecyl, 9-ethoxy-5-oxanonyl or 14-ethoxy-5,10-oxatetradecyl.

Very particularly preferably used phosphonium ions (IVx) are those in which $R^1$ to $R^3$, independently of one another, are $C_1$-$C_{18}$-alkyl, in particular butyl, isobutyl, 1-hexyl or 1-octyl.

Among the abovementioned heterocyclic cations, the pyridinium ions, pyrazolinium ions, pyrazolium ions and the imidazolinium ions and the imidazolium ions are preferred. Ammonium ions are furthermore preferred.

1-Methylpyridinium, 1-ethylpyridinium, 1-(1-butyl)pyridinium, 1-(1-hexyl)pyridinium, 1-(1-octyl)pyridinium, 1-(1-hexyl)pyridinium, 1-(1-octyl)pyridinium, 1-(1-dodecyl)-pyridinium, 1-(1-tetradecyl)pyridinium, 1-(1-hexadecyl) pyridinium, 1,2-dimethyl-pyridinium, 1-ethyl-2-methylpyridinium, 1-(1-butyl)-2-methylpyridinium, 1-(1-hexyl)-2-methylpyridinium, 1-(1-octyl)-2-methylpyridinium, 1-(1-dodecyl)-2-methylpyridinium, 1-(1-tetradecyl)-2-methylpyridinium, 1-(1-hexadecyl)-2-methylpyridinium, 1-methyl-2-ethylpyridinium, 1,2-diethylpyridinium, 1-(1-butyl)-2-ethylpyridinium, 1-(1-hexyl)-2-ethylpyridinium, 1-(1-octyl)-2-ethylpyridinium, 1-(1-dodecyl)-2-ethylpyridinium, 1-(1-tetradecyl)-2-ethylpyridinium, 1-(1-hexadecyl)-2-ethylpyridinium, 1,2-dimethyl-5-ethylpyridinium, 1,5-diethyl-2-methylpyridinium, 1-(1-butyl)-2-methyl-3-ethyl-pyridinium, 1-(1-hexyl)-2-methyl-3-ethylpyridinium, 1-(1-octyl)-2-methyl-3-ethyl-pyridinium, 1-(1-dodecyl)-2-methyl-3-ethylpyridinium, 1-(1-tetradecyl)-2-methyl-3-ethylpyridinium, 1-(1-hexadecyl)-2-methyl-3-ethylpyridinium, 1-methylimidazolium, 1-ethylimidazolium, 1-(1-butyl)imidazolium, 1-(1-octyl) imidazolium, 1-(1-dodecyl)-imidazolium, 1-(1-tetradecyl) imidazolium, 1-(1-hexadecyl)imidazolium, 1,3-dimethyl-imidazolium, 1-ethyl-3-methylimidazolium, 1-(1-butyl)-3-methylimidazolium, 1-(1-hexyl)-3-methylimidazolium, 1-(1-octyl)-3-methylimidazolium, 1-(1-dodecyl)-3-methyl-imidazolium, 1-(1-tetradecyl)-3-methylimidazolium, 1-(1-hexadecyl)-3-methyl-imidazolium, 1,2-dimethylimidazolium, 1,2,3-trimethylimidazolium, 1-ethyl-2,3-dimethylimidazolium, 1-(1-butyl)-2,3-dimethylimidazolium, 1-(1-hexyl)-2,3-dimethyl-imidazolium and 1-(1-octyl)-2,3-dimethylimidazolium, 1,4-dimethylimidazolium, 1,3,4-trimethylimidazolium, 1,4-dimethyl-3-ethylimidazolium, 3-butylimidazolium, 1,4-dimethyl-3-octylimidazolium, 1,4,5-trimethylimidazolium, 1,3,4,5-tetra-methylimidazolium, 1,4,5-trimethyl-3-ethylimidazolium, 1,4,5-trimethyl-3-butylimidazolium, 1,4,5-trimethyl-3-octylimidazolium and 1-(prop-1-en-3-yl)-3-methyl-imidazolium are particularly preferred.

Anions which may be used are in principle all anions.

The anion $[Y]^{n-}$ of the ionic liquid is selected, for example, from the group consisting of the halides and halogen-containing compounds of the formula:

$F^-$, $Cl^-$, $Br^-$, $I^-$, $BF_4^-$, $PF_6^-$, $AlCl_4^-$, $Al_2Cl_7^-$, $Al_3Cl_{10}^-$, $AlBr_4^-$, $FeCl_4^-$, $BCl_4^-$, $SbF_6^-$, $AsF_6^-$, $ZnCl_3^-$, $SnCl_3^-$, $CuCl_2^-$, $CF_3SO_3^-$, $CF_3CO_2^-$, $CCl_3CO_2^-$, $CN^-$, $SCN^-$, $OCN^-$ the group consisting of the sulfates, sulfites and sulfonates of the general formula:

$SO_4^{2-}$, $HSO_4^-$, $SO_3^{2-}$, $HSO_3^-$, $R^aOSO_3^-$, $R^aSO_3^-$ the group consisting of the phosphates of the general formula $PO_4^{3-}$, $HPO_4^{2-}$, $H_2PO_4^-$, $R^aPO_4^{2-}$, $HR^aPO_4^-$, $R^aR^bPO_4^-$ the group consisting of the phosphonates and phosphinates of the general formula:

$R^aHPO_3^-$, $R^aR^bPO_2^-$, $R^aR^bPO_3^-$ the group consisting of the phosphites of the general formula:

$PO_3^{3-}$, $HPO_3^{2-}$, $H_2PO_3^-$, $R^aPO_3^{2-}$, $R^aHPO_3^-$, $R^aR^bPO_3^-$ the group consisting of the phosphonites and phosphinites of the general formula:

$R^aR^bPO_2^-$, $R^aHPO_2^-$, $R^aR^bPO^-$, $R^aHPO^-$ the group consisting of the carboxylic acids of the general formula:

$R^aCOO^-$ the group consisting of the borates of the general formula:

$BO_3^{3-}$, $HBO_3^{2-}$, $H_2BO_3^-$, $R^aR^bBO_3^-$, $R^aHBO_3^-$, $R^aBO_3^{2-}$, $B(OR^a)(OR^b)(OR^c)(OR^d)^-$, $B(HSO_4)^-$, $B(R^aSO_4)^-$ the group consisting of the boronates of the general formula:

$R^aBO_2^{2-}$, $R^aR^bBO^-$ the group consisting of the carbonates and carbonic acid esters of the general formula:

$HCO_3^-$, $CO_3^{2-}$, $R^aCO_3^-$ the group consisting of the silicates and silicic acid esters of the general formula:

$SiO_4^-$, $HSiO_4^-$, $H_2SiO_4^{2-}$, $H_3SiO_4^-$, $R^aSiO_4^{3-}$, $R^aR^bSiO_4^{2-}$, $R^aR^bR^cSiO_4^-$, $HR^aSiO_4^{2-}$, $H_2R^aSiO_4^-$, $HR^aR^bSiO_4^-$ the group consisting of the halometallates of the general formula $[M_qHal_r]^{s-}$, where M is a metal and Hal is fluorine, chlorine, bromine or iodine, q and r are positive integers and specify the stoichiometry of the complex and s is a positive integer and specifies the charge of the complex;

therein, $R^a$, $R^b$, $R^c$ and $R^d$, independently of one another, are in each case hydrogen, $C_1$-$C_{30}$-alkyl, $C_2$-$C_{18}$-alkyl optionally interrupted by one or more non-neighboring oxygen and/or sulfur atoms and/or one or more substituted imino groups, $C_6$-$C_{14}$-aryl, $C_5$-$C_{12}$-cycloalkyl or a five- to six-membered heterocycle having oxygen, nitrogen and/or sulfur atoms, it being possible for two of them together to form an unsaturated, saturated or aromatic ring which is optionally interrupted by one or more oxygen and/or sulfur atoms and/or one or more unsubstituted or substituted imino groups, it being possible for said radicals in each case additionally to be substituted by suitable functional groups, aryl, alkyl, aryloxy, alkoxy, halogen, heteroatoms and/or heterocycles.

Therein, $C_1$-$C_{18}$-alkyl optionally substituted by suitable functional groups, aryl, alkyl, aryloxy, alkoxy, halogen, heteroatoms and/or heterocycles is, for example, methyl, ethyl, propyl, isopropyl, n-butyl, sec-butyl, tert-butyl, pentyl, hexyl, heptyl, octyl, 2-ethylhexyl, 2,4,4-trimethylpentyl, decyl, dodecyl, tetradecyl, hexadecyl, octadecyl, 1,1-dimethylpropyl, 1,1-dimethylbutyl, 1,1,3,3-tetramethylbutyl, benzyl, 1-phenylethyl, α,α-dimethylbenzyl, benzhydryl, p-tolylmethyl, 1-(p-butylphenyl)ethyl, p-chlorobenzyl, 2,4-dichlorobenzyl, p-methoxybenzyl, m-ethoxybenzyl, 2-cyanoethyl, 2-cyanopropyl, 2-methoxycarbonylethyl, 2-ethoxycarbonylethyl, 2-butoxycarbonylpropyl, 1,2-di(methoxycarbonyl) ethyl, 2-methoxyethyl, 2-ethoxyethyl, 2-butoxyethyl, diethoxymethyl, diethoxyethyl, 1,3-dioxolan-2-yl, 1,3-dioxan-2-yl, 2-methyl-1,3-dioxolan-2-yl, 4-methyl-1,3-dioxolan-2-yl, 2-isopropoxyethyl, 2-butoxypropyl, 2-octyloxyethyl, chloromethyl, trichloromethyl, trifluoromethyl, 1,1-dimethyl-2-chloroethyl, 2-methoxyisopropyl, 2-ethoxyethyl, butylthiomethyl, 2-dodecylthioethyl, 2-phenylthioethyl, 2,2,2-trifluoroethyl, 2-dimethylaminoethyl, 2-dimethylaminopropyl, 3-dimethylaminopropyl, 4-dimethylaminobutyl, 6-dimethylaminohexyl, 2-phenoxyethyl, 2-phenoxypropyl, 3-phenoxypropyl, 4-phenoxybutyl, 6-phenoxyhexyl, 2-methoxyethyl, 2-methoxypropyl, 3-methoxypropyl, 4-methoxybutyl, 6-methoxyhexyl, 2-ethoxyethyl, 2-ethoxypropyl, 3-ethoxypropyl, 4-ethoxybutyl or 6-ethoxyhexyl.

$C_2$-$C_{18}$-Alkyl optionally interrupted by one or more non-neighboring oxygen and/or sulfur atoms and/or one or more substituted or unsubstituted imino groups is, for example, 5-methoxy-3-oxapentyl, 8-methoxy-3,6-dioxaoctyl, 11-methoxy-3,6,9-trioxaundecyl, 7-methoxy-4-oxaheptyl, 11-methoxy-4,8-dioxaundecyl, 15-methoxy-4,8,12-trioxapentadecyl, 9-methoxy-5-oxanonyl, 14-methoxy-5,10-oxatetradecyl, 5-ethoxy-3-oxapentyl, 8-ethoxy-3,6-dioxaoctyl, 11-ethoxy-3,6,9-trioxaundecyl, 7-ethoxy-4-oxaheptyl, 11-ethoxy-4,8-dioxaundecyl, 15-ethoxy-4,8,12-trioxapentadecyl, 9-ethoxy-5-oxanonyl or 14-ethoxy-5,10-oxatetradecyl.

If two radicals form a ring, these radicals together in the form of a fused building block, for example, may be 1,3-propylene, 1,4-butylene, 2-oxa-1,3-propylene, 1-oxa-1,3-propylene, 2-oxa-1,3-propenylene, 1-aza-1,3-propenylene, 1-$C_1$-$C_4$-alkyl-1-aza-1,3-propenylene, 1,4-buta-1,3-dienylene, 1-aza-1,4-buta-1,3-dienylene or 2-aza-1,4-buta-1,3-dienylene.

The number of non-neighboring oxygen and/or sulfur atoms and/or imino groups is in principle not limited or is automatically limited by the size of the radical or of the ring building block. As a rule, it is not more than 5 in the respective radical, preferably not more than 4 or very particularly preferably not more than 3. Furthermore, as a rule at least one carbon atom, preferably at least two carbon atoms, is or are present between two heteroatoms.

Substituted and unsubstituted imino groups may be, for example, imino, methylimino, isopropylimino, n-butylimino or tert-butylimino.

The term "functional groups" is to be understood as meaning, for example, the following: di($C_1$-$C_4$-alkyl)amino, $C_1$-$C_4$-alkoxycarbonyl, cyano or $C_1$-$C_4$-alkoxy. $C_1$ to $C_4$-alkyl is methyl, ethyl, propyl, isopropyl, n-butyl, sec-butyl or tert-butyl.

$C_6$-$C_{14}$-Aryl optionally substituted by suitable functional groups, aryl, alkyl, aryloxy, alkoxy, halogen, heteroatoms and/or heterocycles is, for example, phenyl, tolyl, xylyl, α-naphthyl, β-naphthyl, 4-diphenylyl, chlorophenyl, dichlorophenyl, trichlorophenyl, difluorophenyl, methylphenyl, dimethylphenyl, trimethylphenyl, ethylphenyl, diethylphenyl, isopropylphenyl, tert-butylphenyl, dodecylphenyl, methoxyphenyl, dimethoxyphenyl, ethoxyphenyl, hexyloxyphenyl, methylnaphthyl, isopropylnaphthyl, chloronaphthyl, ethoxynaphthyl, 2,6-dimethylphenyl, 2,4,6-trimethylphenyl, 2,6-dimethoxyphenyl, 2,6-dichlorophenyl, 4-bromophenyl, 2- or 4-nitrophenyl, 2,4- or 2,6-dinitrophenyl, 4-dimethylaminophenyl, 4-acetylphenyl, methoxyethylphenyl or ethoxymethylphenyl.

$C_5$-$C_{12}$-Cycloalkyl optionally substituted by suitable functional groups, aryl, alkyl, aryloxy, halogen, heteroatoms and/or heterocycles is, for example, cyclopentyl, cyclohexyl, cyclooctyl, cyclododecyl, methylcyclopentyl, dimethylcyclopentyl, methylcyclohexyl, dimethylcyclohexyl, diethylcyclohexyl, butylcyclohexyl, methoxycyclohexyl, dimethoxycyclohexyl, diethoxycyclohexyl, butylthiocyclohexyl, chlorocyclohexyl, dichlorocyclohexyl, dichlorocyclopentyl and a saturated or unsaturated bicyclic system, such as norbornyl or norbornenyl.

A five- to six-membered heterocycle having oxygen, nitrogen and/or sulfur atoms is, for example, furyl, thiophenyl, pyryl, pyridyl, indolyl, benzoxazolyl, dioxolyl, dioxyl, benzimidazolyl, benzthiazolyl, dimethylpyridyl, methylquinolyl, dimethylpyryl, methoxyfuryl, dimethoxypyridyl, difluoropyridyl, methylthiophenyl, isopropylthiophenyl or tert-butylthiophenyl.

Preferably used ionic liquids are 1-ethyl-3-methylimidazolium chloride, 1-ethyl-3-methylimidazolium methanesulfonate, 1-butyl-3-methylimidazolium chloride, 1-butyl-3-methylimidazolium methanesulfonate, methyl-tri-n-butylammonium methylsulfate, 1,2,4-trimethylpyrazolium methylsulfate, 1-ethyl-2,3-dimethylimidazolium ethylsulfate, 1,2,3-trimethylimidazolium methylsulfate, methylimidazolium chloride, methylimidazolium hydrogen sulfate, 1-ethyl-3-methylimidazolium hydrogen sulfate, 1-ethyl-3-methylimidazolium tetrachloroaluminate, 1-butyl-3-methylimidazolium hydrogen sulfate, 1-butyl-3-methylimidazolium tetrachloroaluminate, 1-ethyl-3-methylimidazolium acetate, 1-butyl-3-methylimidazolium acetate, 1-ethyl-3-methylimidazolium ethylsulfate, 1-butyl-3-methylimidazolium methylsulfate, 1-ethyl-3-methylimidazolium thiocyanate, 1-butyl-3-methylimidazolium thiocyanate, choline acetate, choline salicylate, tris(2-hydroxyethyl)methylammonium methylsulfate and/or 1-ethyl-3-methylimidazolium diethylphosphate.

1-Ethyl-3-methylimidazolium methanesulfonate, 1-ethyl-2,3-dimethylimidazolium ethylsulfate, 1-ethyl-3-methylimidazolium diethylphosphate and/or 1-ethyl-3-methylimidazolium chloride are particularly preferred.

In this document, the term "textile substrate" is understood as meaning all known two-dimensional structures which are known to be capable of being coated with polyurethane by means of coagulation. Preferable as textile substrates are those based on natural fibers, e.g. cellulose, for example cotton, and/or synthetic fibers, e.g. polyamide, polyester, thermoplastic polyurethane or spandex. The substrates may preferably be present in the form of woven fabrics, knitted fabrics or nonwovens. Nonwovens are particularly preferably used as textile substrate for coating with the solution (I).

After the coating, in which the textile substrate may also be impregnated, the coated substrate is usually passed through a coagulation bath in which the polyurethane is precipitated, i.e. coagulated. The precipitation is effected as described, preferably in water, i.e. the polyurethane, preferably thermoplastic polyurethane, is preferably coagulated, i.e. precipitated, in a bath comprising water. The coagulant used is preferably a mixture (II). The mixture (II) comprises water and, if appropriate, ionic liquid. The weight ratio of water to ionic liquid in the mixture (II) can be chosen in a wide range. The ratio is determined by the coagulation properties of water in the mixture and by the possibility of separation from the ionic liquid after leaving the coagulation bath. The maximum concentration of ionic liquid in water in the mixture (II) preferably depends here on the coagulation properties of water in the ionic liquid. The minimum concentration of ionic liquid in water preferably depends on the possibilities for separating water and ionic liquid.

After the coagulation, the coated textile generally still comprises a residual content of ionic liquids. Coated textiles, in particular imitation leather comprising ionic liquid, are therefore also preferred, the content of ionic liquid in the polyurethane preferably being less than 10% by weight, based on the total weight of the polyurethane comprising the ionic liquid.

The coated textiles according to the invention can be used in particular for products which are described in W. Schröer, Textilveredlung 1987, 22 (12), page 467, chapter 6.

We claim:

1. A process for the production of coated textiles, wherein a textile substrate is coated or impregnated with a solution (I) comprising polyurethane, and thereafter, the polyurethane is precipitated in or on the textile substrate, wherein polyurethane dissolved in ionic liquid is solution (I).

2. The process according to claim 1, wherein the solution (I) is produced by preparing the polyurethane in the ionic liquid.

3. The process according to claim 1, wherein the solution (I) is produced by dissolving polyurethane in ionic liquids.

4. The process according to claim 1, wherein the solution (I) comprises thermoplastic polyurethane.

5. The process according to claim 1, wherein the polyurethane is formed by the reaction of (a) isocyanate with (b) compounds reactive toward isocyanates and having a molecular weight of from 500 g/mol to 10 000 g/mol and (c) chain extenders.

6. The process according to claim 5, wherein the polyurethane is a thermoplastic polyurethane.

7. The process according to claim 1, wherein the ionic liquid is at least one member selected from the group consisting of 1-ethyl-3-methylimidazolium methanesulfonate, 1-ethyl-2,3-dimethylimidazolium ethylsulfate, 1-ethyl-3-methylimidazolium diethylphosphate and 1-ethyl-3 methylimidazolium chloride.

8. The process according to claim 1, wherein the textile substrate is a woven fabric, knitted fabric or nonwoven based on natural or synthetic fibers.

9. The process according to claim 1, wherein the textile substrate is a nonwoven.

10. The process according to claim 1, wherein the polyurethane is precipitated in a bath comprising water.

11. A coated textile obtained by the process according to claim 1.

12. The coated textile according to claim 11, wherein the coated textile comprises ionic liquid.

13. The coated textile according to claim 11, wherein the coated textile is imitation leather.

14. The process according to claim 1, wherein the polyurethane is formed by the reaction of (a) isocyanate with (b) compounds reactive toward isocyanates and having a molecular weight of from 500 g/mol to 10 000 g/mol, (c) chain extenders, and in the presence of at least one of (d) a catalyst and (e) an assistant.

15. The process according to claim 1, wherein said solution (I) comprises said polyurethane and said ionic liquid in a weight ratio of 20:1 to 1:10.

16. The process according to claim 1, wherein said solution (I) comprises said polyurethane and said ionic liquid in a weight ratio of 4:1 to 2:1.

17. The process according to claim 1, wherein said ionic liquid has a melting point of −50 to 150° C.

18. The process according to claim 1, wherein said ionic liquid has a melting point of −20 to 120° C.

19. A process for the production of coated textiles, comprising coating a textile substrate with a solution (I), and thereafter precipitating the polyurethane in the textile substrate, wherein solution (I) comprises at least one polyurethane dissolved in the presence of at least one ionic liquid.

20. The process according to claim 19, further comprising forming solution (I) by reacting in the presence of at least one ionic liquid:

(a) at least one isocyanate;

(b) at least one compound reactive toward isocyanates and having a molecular weight of from 500 g/mol to 10 000 g/mol; and (c) at least one chain extender.

* * * * *